US008496317B2

(12) United States Patent
Ciminelli et al.

(10) Patent No.: US 8,496,317 B2
(45) Date of Patent: Jul. 30, 2013

(54) METALIZED PRINTHEAD SUBSTRATE OVERMOLDED WITH PLASTIC

(75) Inventors: Mario J. Ciminelli, Rochester, NY (US); Eric A. Merz, Hilton, NY (US); Dwight J. Petruchik, Honeoye Falls, NY (US)

(73) Assignee: Eastman Kodak Company, Rochester, NY (US)

( * ) Notice: Subject to any disclaimer, the term of this patent is extended or adjusted under 35 U.S.C. 154(b) by 661 days.

(21) Appl. No.: 12/538,921

(22) Filed: Aug. 11, 2009

(65) Prior Publication Data

US 2011/0037808 A1 Feb. 17, 2011

(51) Int. Cl.
*B41J 2/14* (2006.01)
*B41J 2/16* (2006.01)

(52) U.S. Cl.
USPC ..... 347/50

(58) Field of Classification Search
None
See application file for complete search history.

(56) References Cited

U.S. PATENT DOCUMENTS

| | | | | |
|---|---|---|---|---|
| 4,873,622 | A | 10/1989 | Komuro et al. | |
| 4,881,318 | A | 11/1989 | Komuro et al. | |
| 6,114,962 | A | 9/2000 | Wiklof et al. | |
| 6,227,651 | B1 | 5/2001 | Watts et al. | |
| 6,518,885 | B1 | 2/2003 | Brady et al. | |
| 6,755,516 | B2 | 6/2004 | Hanson et al. | |
| 2003/0193545 | A1 | 10/2003 | Boucher et al. | |
| 2004/0046824 | A1 | 3/2004 | Kawamura et al. | |
| 2004/0100522 | A1 | 5/2004 | Horvath et al. | |
| 2005/0117001 | A1* | 6/2005 | Martin | 347/85 |
| 2008/0149024 | A1* | 6/2008 | Petruchik et al. | 118/300 |
| 2008/0158298 | A1 | 7/2008 | Serbicki et al. | |

FOREIGN PATENT DOCUMENTS

EP 0 289 347 A2 11/1988

* cited by examiner

*Primary Examiner* — Matthew Luu
*Assistant Examiner* — Renee I Wilson
(74) *Attorney, Agent, or Firm* — William R. Zimmerli

(57) ABSTRACT

A liquid ejector includes an electrically insulating support having a first surface and a second surface. An electrical trace begins on the first surface of the support and ends on the second surface of the support. An ejector die is positioned on the first surface of the support and electrically connected to the portion of the electrical trace located on the first surface of the support. A polymer material is molded on a portion of the ejector die and at least a portion of the first surface of the support. A portion of the electrical trace remains free of the polymer material.

20 Claims, 15 Drawing Sheets

METALIZED PRINTHEAD SUBSTRATE OVERMOLDED WITH PLASTIC

FIELD OF THE INVENTION

This invention relates generally to the field of printheads, and more particularly to a mounting substrate for the ejector die of the printhead.

BACKGROUND OF THE INVENTION

A mounting substrate for a liquid ejection device, such as an inkjet printhead, has conventionally been made by an insert molding process that forms both the die-attach portion for the liquid ejection device(s), including the fluid feed channels or slots with lands there-between, and a housing portion including alignment and fastening features, such as bolt holes. Such a mounting substrate is described in US Published Application No. 2008/0149024 (incorporated herein). Affixed to such a mounting substrate are one or more inkjet ejector die, an electrical lead pattern (such as a flex circuit) for providing electrical interconnection to the inkjet ejector die, and a manifold for providing fluid connection between the tight spacings of the fluid feed channels and the wider spacings of the ink tanks In addition, after electrical connection between the inkjet ejector die and the electrical lead pattern has been provided, for example by wirebonding, encapsulation is deposited over the interconnection region for mechanical and environmental protection.

Although the mounting substrate described in US Published Application No. 2008/0149024 works well, in some applications it is preferable to have fewer discrete parts. Fewer parts enables manufacturing processes that include fewer assembly steps. In addition, a configuration having fewer interfaces between discrete assembled parts can have fewer potential points of failure, thereby improving reliability during operation.

What is needed is a mounting substrate that incorporates electrical leads, protection around the interconnections to the inkjet ejector die, and optionally fluid channels to the die, as well as alignment features, provided in a simple integrated fashion.

SUMMARY OF THE INVENTION

According to one aspect of the present invention, a liquid ejector includes an electrically insulating support having a first surface and a second surface. An electrical trace begins on the first surface of the support and ends on the second surface of the support. An ejector die is positioned on the first surface of the support and is electrically connected to the portion of the electrical trace located on the first surface of the support. A polymer material is molded on a portion of the ejector die and at least a portion of the first surface of the support. A portion of the electrical trace remains free of the polymer material.

According to another aspect of the present invention, a liquid ejector includes an electrically insulating support having a surface. An electrical trace includes a first end and a second end with the first end and the second end being located on the surface of the support. An ejector die is positioned on the surface of the support and is electrically connected to the first end of the electrical trace. A polymer material is molded on a portion of the ejector die and at least a portion of the surface of the support including the first end of the electrical trace. The second end of the electrical trace remains free of the polymer material.

According to another aspect of the present invention, an inkjet printer includes a carriage and a printhead mounted on the carriage. The printhead includes an electrically insulating support having a first surface and a second surface. An electrical trace is located on the first surface of the support. An ejector die is positioned on the first surface of the support and is electrically connected to the portion of the electrical trace located on the first surface of the support. A polymer material is molded on a portion of the ejector die and at least a portion of the first surface of the support. A portion of the electrical trace remains free of the polymer material.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
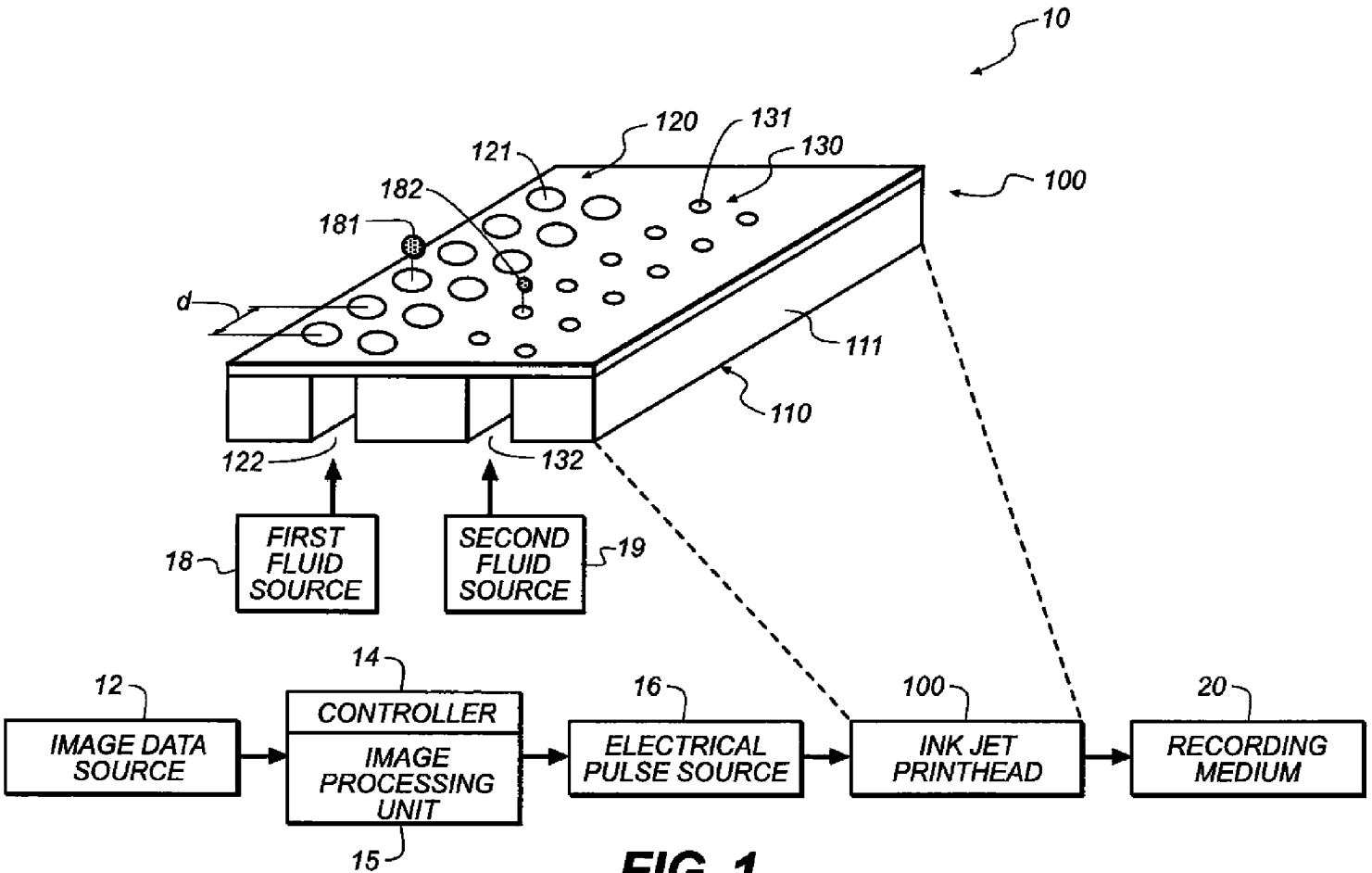
FIG. 1 is a schematic representation of an inkjet printer system.

Referring to FIG. 1, a schematic representation of an inkjet printer system 10 is shown, for its usefulness with the present invention and is fully described in U.S. Pat. No. 7,350,902, the disclosure of which is incorporated by reference herein. Inkjet printer system 10 includes an image data source 12, which provides data signals that are interpreted by a controller 14 as being commands to eject drops. Controller 14 includes an image processing unit 15 for rendering images for printing, and outputs signals to an electrical pulse source 16 of electrical energy pulses that are inputted to an inkjet printhead 100, which includes at least one inkjet printhead die 110.

In the example shown in FIG. 1, there are two nozzle arrays. Nozzles 121 in the first nozzle array 120 have a larger opening area than nozzles 131 in the second nozzle array 130. In this example, each of the two nozzle arrays has two staggered rows of nozzles, each row having a nozzle density of 600 per inch. The effective nozzle density then in each array is 1200 per inch (i.e. d=1/1200 inch in FIG. 1). If pixels on the recording medium 20 were sequentially numbered along the paper advance direction, the nozzles from one row of an array would print the odd numbered pixels, while the nozzles from the other row of the array would print the even numbered pixels.

In fluid communication with each nozzle array is a corresponding ink delivery pathway Ink delivery pathway 122 is in fluid communication with the first nozzle array 120, and ink delivery pathway 132 is in fluid communication with the second nozzle array 130. Portions of ink delivery pathways 122 and 132 are shown in FIG. 1 as openings through printhead die substrate 111. One or more inkjet printhead die 110 are included in inkjet printhead 100, but for greater clarity only one inkjet printhead die 110 is shown in FIG. 1. The printhead die are arranged on a mounting substrate member as discussed below with reference to FIG. 2. In FIG. 1, first fluid source 18 supplies ink to first nozzle array 120 via ink delivery pathway 122, and second fluid source 19 supplies ink to second nozzle array 130 via ink delivery pathway 132. Although distinct fluid sources 18 and 19 are shown, in some applications it is beneficial to have a single fluid source supplying ink to both the first nozzle array 120 and the second nozzle array 130 via ink delivery pathways 122 and 132 respectively. Also, in some embodiments, fewer than two or more than two nozzle arrays can be included on printhead die 110. In some embodiments, all nozzles on inkjet printhead die 110 can be the same size, rather than having multiple sized nozzles on inkjet printhead die 110.

Drop forming mechanisms (not shown in FIG. 1) are associated with the nozzles. Drop forming mechanisms can be of a variety of types, some of which include a heating element to vaporize a portion of ink and thereby cause ejection of a droplet, a piezoelectric transducer to constrict the volume of a fluid chamber and thereby cause ejection, or an actuator which is made to move (for example, by heating a bi-layer element) and thereby cause ejection. In any case, electrical pulses from electrical pulse source 16 are sent to the various drop ejectors according to the desired deposition pattern. In the example shown in FIG. 1, droplets 181 ejected from the first nozzle array 120 are larger than droplets 182 ejected from the second nozzle array 130, due to the larger nozzle opening area. Typically aspects of the drop forming mechanisms associated with nozzle arrays 120 and 130 are also sized differently in order to optimize the drop ejection process for the different sized drops. During operation, droplets of ink are deposited on a recording medium 20.

Figure 2:
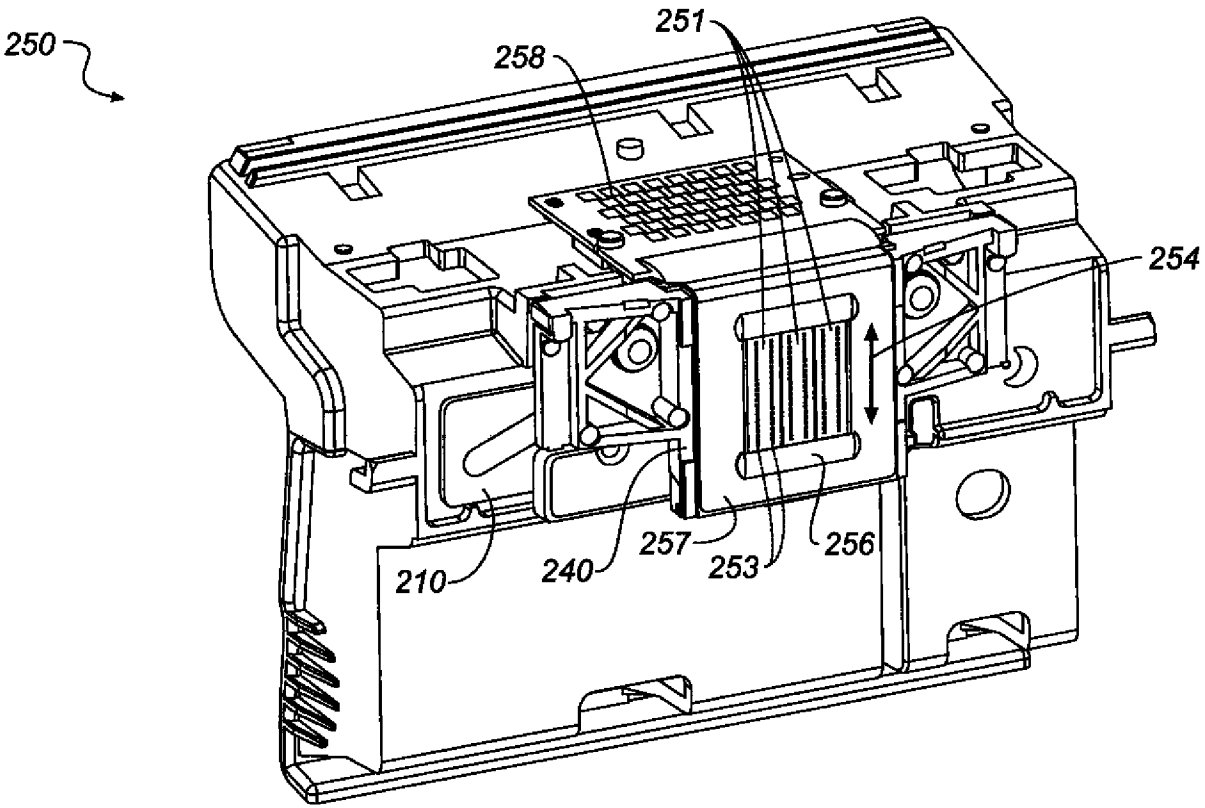
FIG. 2 is a perspective view of a portion of a printhead chassis.

FIG. 2 shows a perspective view of a portion of a printhead chassis 250, which provides an example of an inkjet printhead 100. Printhead chassis 250 includes three printhead die 251 (similar to printhead die 110 in FIG. 1), each printhead die 251 includes two nozzle arrays 253, so that printhead chassis 250 contains six nozzle arrays 253 altogether. When referring to the inkjet printhead, the terms printhead die and ejector die are used herein interchangeably. The six nozzle arrays 253 in this example can each be connected to separate ink sources (not shown in FIG. 2) such as cyan, magenta, yellow, text black, photo black, and a colorless protective printing fluid. Each of the six nozzle arrays 253 is disposed along nozzle array direction 254, and the length of each nozzle array along the nozzle array direction 254 is typically on the order of 1 inch or less. Typical lengths of recording media are 6 inches for photographic prints (4 inches by 6 inches) or 11 inches for paper (8.5 by 11 inches). Thus, in order to print a full image, a number of swaths are successively printed while moving printhead chassis 250 across the recording medium 20. Following the printing of a swath, the recording medium 20 is advanced along a media advance direction that is substantially parallel to nozzle array direction 254.

Figure 3:
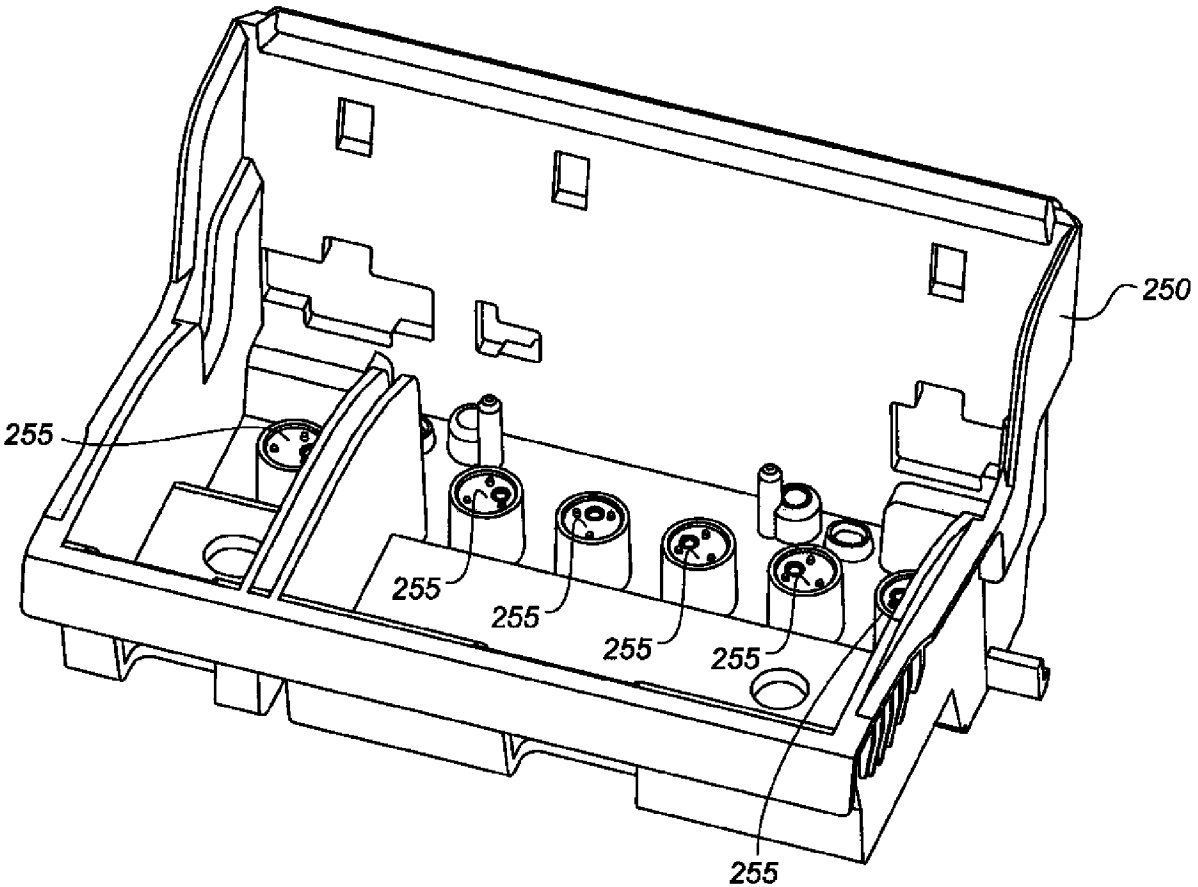
FIG. 3 is a perspective view of a portion of a printhead chassis that is rotated from the view of FIG. 2.

FIG. 3 shows a perspective view of printhead chassis 250, which is rotated relative to the view of FIG. 2, so that the ink inlet ports 255 can be seen. Ink inlet ports 255 connect to disconnectable ink tanks as described below.

Figure 4:
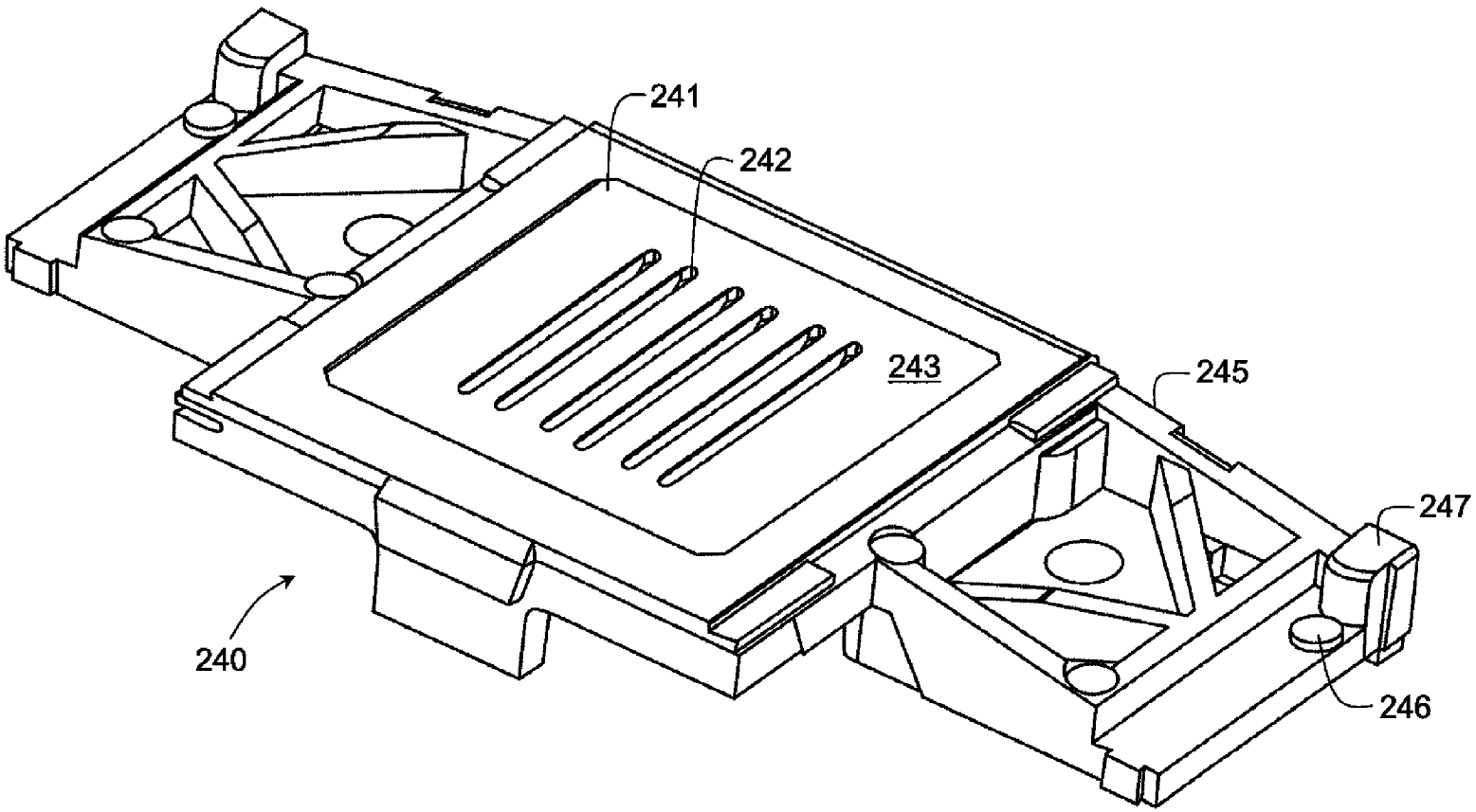
FIG. 4 (PRIOR ART)
FIG. 4 is a prior art insert molded mounting substrate.

The example of FIG. 2 includes a prior art insert molded mounting substrate 240 described in US Published Application No. 2008/0149024. Insert molded mounting substrate 240 is shown in more detail in FIG. 4 and includes a die mounting portion 241 and an extension 245. Die mounting portion 241 can be a ceramic piece that is inserted into an injection molding tool (not shown), so that extension 245 is molded around the ceramic insert. Die mounting portion 241 includes ink passageways that are shown as slots 242 that are exposed at die mount surface 243. There are six slots 242 corresponding to the six nozzle arrays of FIG. 2. Extension 245 optionally includes alignment features 246 and 247. Alignment features 246 and 247 are used to align printhead chassis 250 to print carriage 200 (shown in FIG. 6). Alignment features 246 define front to back and angular position of printhead die 251 relative to print carriage 200 while alignment features 247 define side to side position of printhead die 251 relative to the print carriage 200. During printhead assembly, printhead die 251 are affixed to die mounting portion 241 in such a way that the ink delivery pathways (for example, slots 122 and 132 shown in FIG. 1) of printhead die 251 are fluidically connected and individually sealed to the slots 242.

Figure 5:
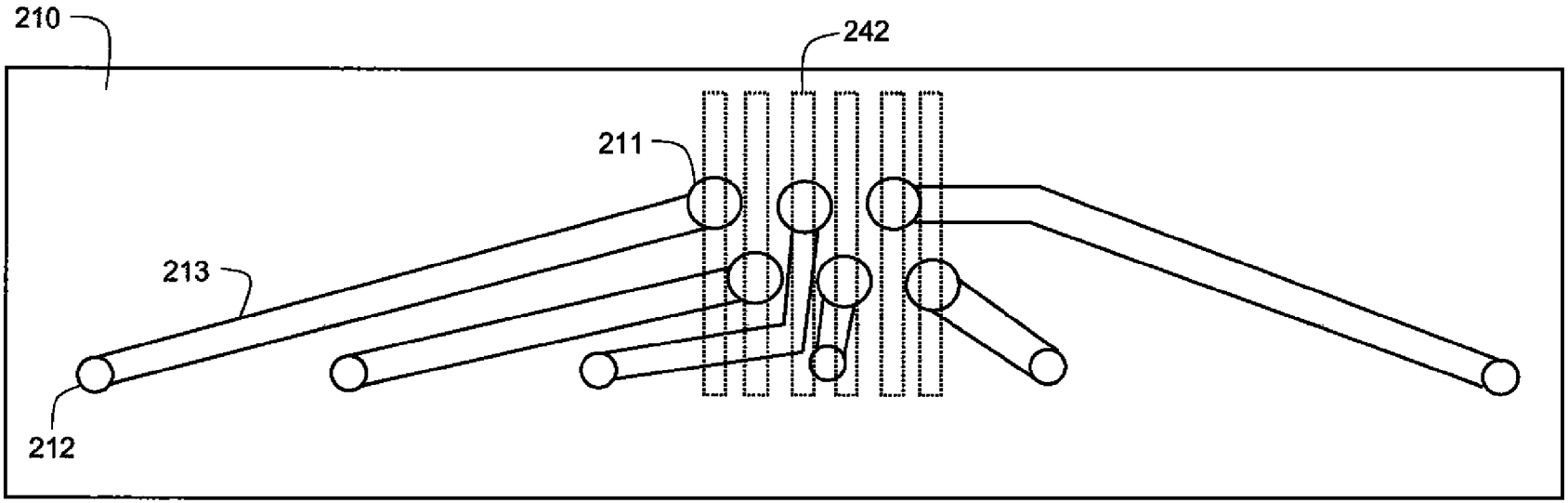
FIG. 5 (PRIOR ART)
FIG. 5 is a prior art manifold.

The example of FIG. 2 also includes a prior art manifold 210 that is affixed (for example by laser welding) to printhead chassis 250. FIG. 5 shows a schematic representation of manifold 210 in relation to slots 242 of die mounting portion 241. Manifold 210 transports the ink from the ink inlet ports 255 of the printhead chassis 250 to the corresponding slots 242 of the die mounting portion 241. Since the ink inlet ports 255 are more widely spaced than the slots 242, each manifold passageway includes a slot connection end 211, a port connection end 212, and a fan-out path 213.

Also shown in FIG. 2 is a flex circuit 257 to which the printhead die 251 are electrically interconnected, for example, by wire bonding or TAB bonding. The interconnections are covered by an encapsulant 256 to protect them. Flex circuit 257 bends around the side of printhead chassis 250 and connects to connector board 258. When printhead chassis 250 is mounted into the carriage 200 (as shown in FIG. 6), connector board 258 is electrically connected to a connector (not shown) on the carriage 200, so that electrical signals can be transmitted to the printhead die 251.

Figure 6:
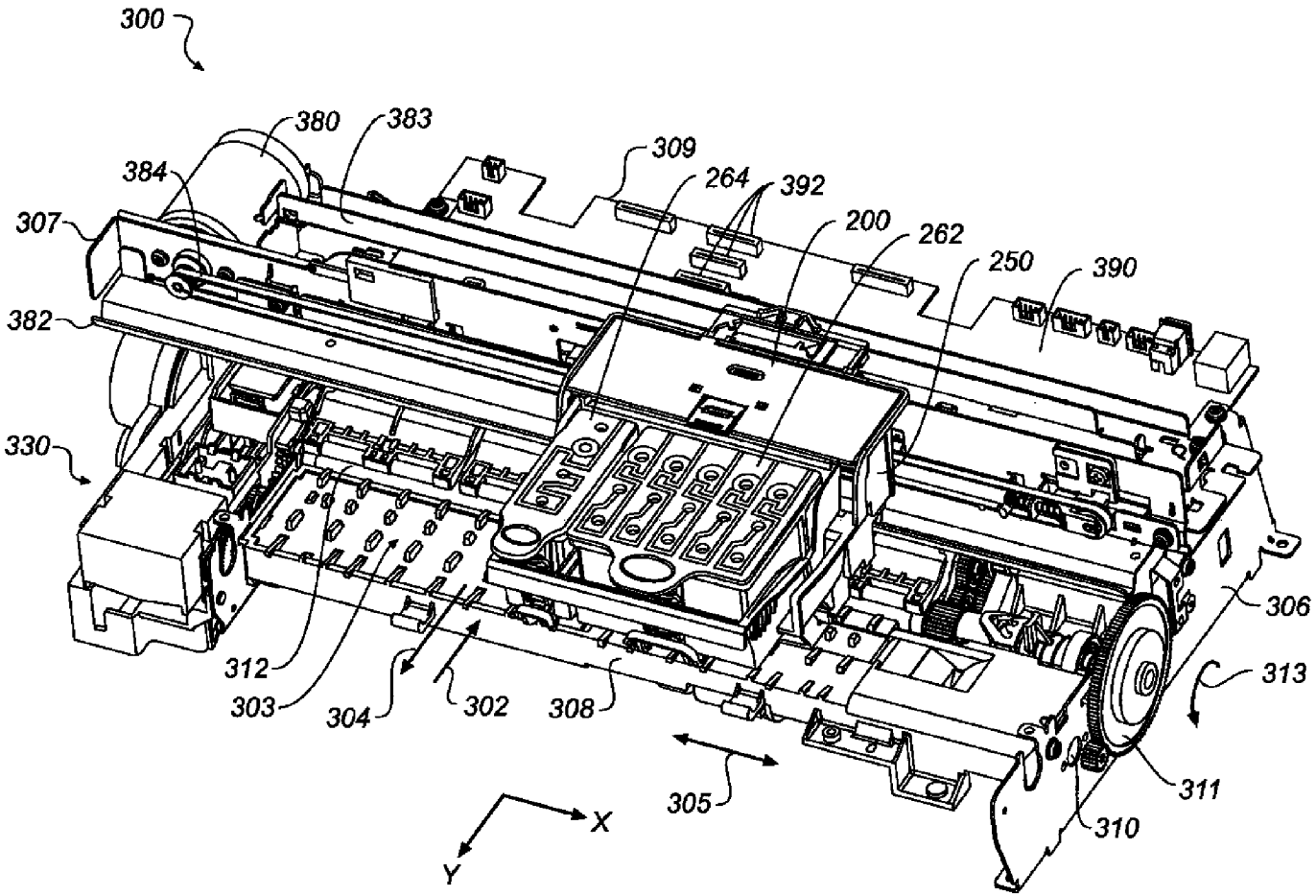
FIG. 6 is a perspective view of a portion of a carriage printer.

FIG. 6 shows a portion of a desktop carriage printer. Some of the parts of the printer have been hidden in the view shown in FIG. 6 so that other parts can be more clearly seen. Printer chassis 300 has a print region 303 across which carriage 200 is moved back and forth in carriage scan direction 305 along the X axis, between the right side 306 and the left side 307 of printer chassis 300, while drops are ejected from printhead die 251 (not shown in FIG. 6) included on printhead chassis 250 that is mounted on carriage 200. Carriage motor 380 moves belt 384 to move carriage 200 along carriage guide rail 382. An encoder sensor (not shown) is mounted on carriage 200 and indicates carriage location relative to an encoder fence 383.

Printhead chassis 250 is mounted in carriage 200, and multi-chamber ink supply 262 and single-chamber ink supply 264 are mounted in the printhead chassis 250. The mounting orientation of printhead chassis 250 is rotated relative to the view in FIG. 2, so that the printhead die 251 are located at the bottom side of printhead chassis 250, the droplets of ink being ejected downward onto the recording medium in print region 303 in the view shown in FIG. 6. Multi-chamber ink supply 262, in this example, contains five ink sources: cyan, magenta, yellow, photo black, and colorless protective fluid; while single-chamber ink supply 264 contains the ink source for text black. Paper or other recording medium (sometimes generically referred to as paper or media herein) is loaded along paper load entry direction 302 toward the front of printer chassis 308.

Figure 7:
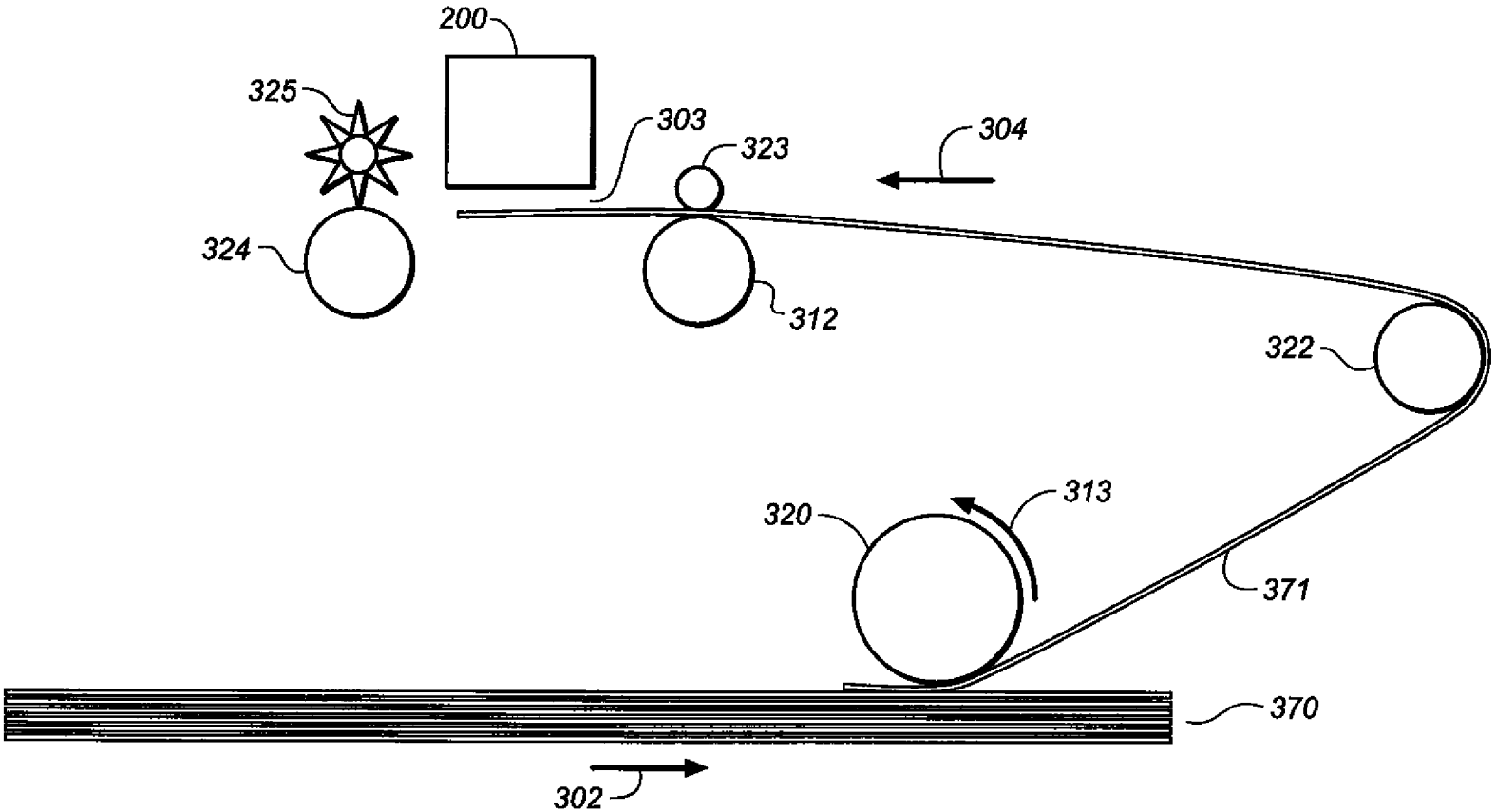
FIG. 7 is a schematic side view of an exemplary paper path in a carriage printer.

A variety of rollers are used to advance the medium through the printer as shown schematically in the side view shown in FIG. 7. In this example, a pick-up roller 320 moves the top piece or sheet 371 of a stack 370 of paper or other recording medium in the direction of arrow, paper load entry direction 302. A turn roller 322 acts to move the paper around a C-shaped path (in cooperation with a curved rear wall surface) so that the paper continues to advance along media advance direction 304 from the rear 309 of the printer chassis (also shown in FIG. 6). The paper is then moved by feed roller 312 and idler roller(s) 323 to advance along the Y axis across print region 303, and from there to a discharge roller 324 and star wheel(s) 325 so that printed paper exits along media advance direction 304. Feed roller 312 includes a feed roller shaft along its axis, and feed roller gear 311 (shown in FIG. 6) is mounted on the feed roller shaft. Feed roller 312 can include a separate roller mounted on the feed roller shaft, or can include a thin high friction coating on the feed roller shaft. A rotary encoder (not shown) can be coaxially mounted on the feed roller shaft in order to monitor the angular rotation of the feed roller.

The motor that powers the paper advance rollers is not shown in FIG. 6, but the hole 310 at the right side of the printer chassis 306 is where the motor gear (not shown) protrudes through in order to engage feed roller gear 311, as well as the gear for the discharge roller (not shown). For normal paper pick-up and feeding, it is desired that all rollers rotate in forward rotation direction 313. Toward the left side of the printer chassis 307, in the example of FIG. 6, is the maintenance station 330.

Toward the rear of the printer chassis 309, in this example, is located the electronics board 390, which includes cable connectors 392 for communicating via cables (not shown) to the printhead carriage 200 and from there to the printhead chassis 250. Also on the electronics board are typically mounted motor controllers for the carriage motor 380 and for the paper advance motor, a processor and/or other control electronics (shown schematically as controller 14 and image processing unit 15 in FIG. 1) for controlling the printing process, and an optional connector for a cable to a host computer.

Aspects of the present invention involve replacing insert molded mounting substrate 240, manifold 210, at least a portion of flex circuit 257, and encapsulant 256 shown in FIG. 2 with a metalized substrate that is overmolded with plastic after the printhead die 251 have been affixed to the metalized substrate.

Figure 8B:
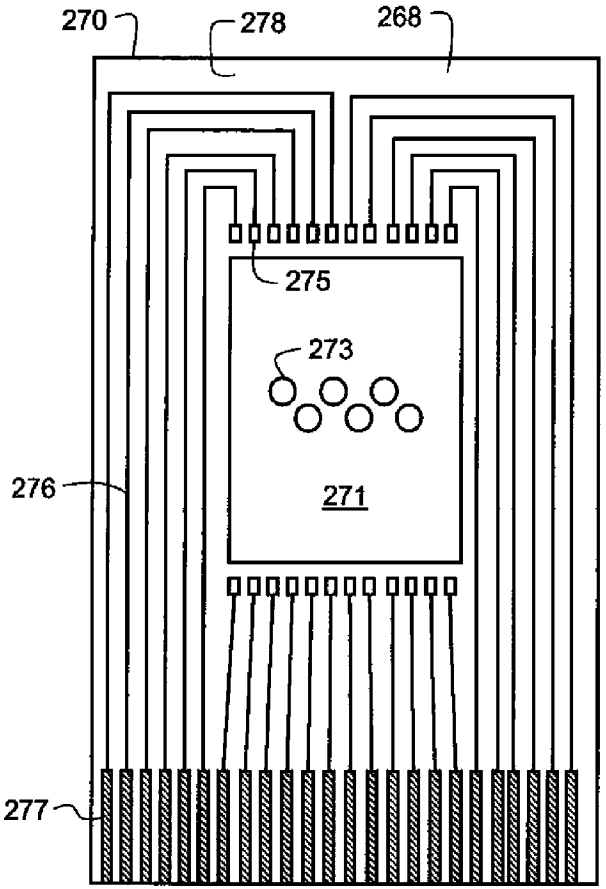
FIGS. 8A and 8B are schematic top views of single sided metalized substrates.
Figure 8A:
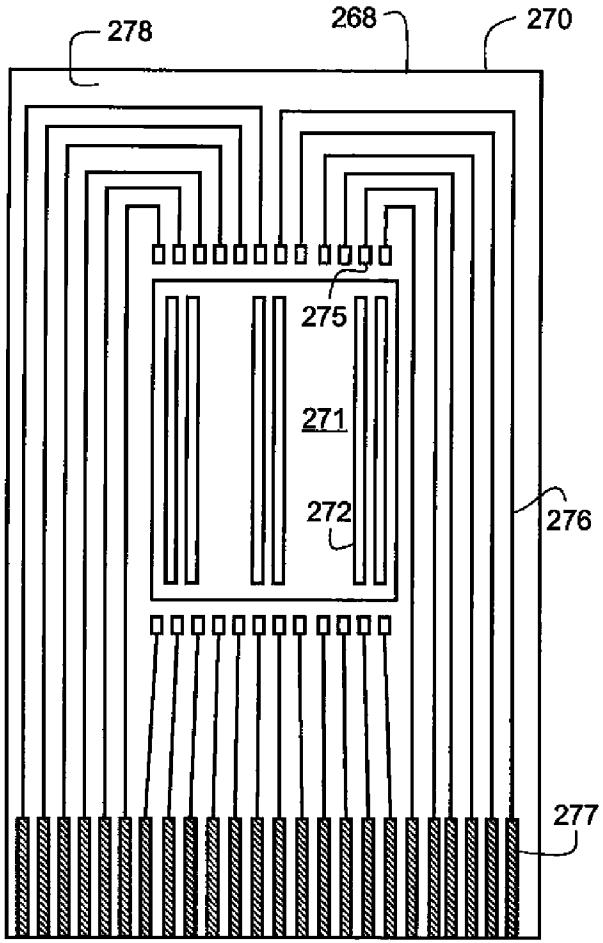

FIGS. 8A and 8B show schematic representations of single sided metalized substrates 270 that can be used in embodiments of the present invention. Metalized substrate 270 has an electrically insulating support 268 such as FR4, BT, or ceramic on which electrical traces have been patterned on a first surface 278. For printed circuit substrates such as FR4 and BT, the electrical traces can include layers of nickel, copper and gold, for example. For ceramic substrates, the electrical traces can be screen printed and fired, as is well known in the art. The electrical traces include bond pads 275 for wire bonding to the printhead die 251, connection pads 277, and leads 276 to connect the bond pads 275 to corresponding connection pads 277. Metalized substrate 270 includes a die mount region 271 on first surface 278 of electrically insulating support 268 for mounting printhead die 251.

In the example embodiments of the present invention, the portion of first surface 278 that includes die mount region 271 can be exposed (not metalized) or the portion of first surface 278 that includes die mount region 271 can be metalized. Accordingly, when the portion of first surface 278 of support 268 that includes die mount region 271 is referred to herein, it is specifically contemplated that this portion of first surface 278 can be metalized or exposed. Typically, die mount region 271 of first surface 278 is metalized to provide better ejector die bondability, to provide a ground plane, or to improve heat dissipation.

Fluid passageways are formed through the electrically insulating support 268 (extending from a second surface opposite the first surface 278 to the first surface 278) for connecting to ink delivery pathways (e.g. 122 and 132) of printhead die 251. In the embodiment of FIG. 8A these fluid passageways are ink slots 272, while in the embodiment of FIG. 8B they are ink holes 273. Fluid passageways such as ink slots 272 or ink holes 273 formed through the electrically insulating support 268 can optionally be metalized. For the electrically insulating supports 268 formed of printed circuit materials, metalized fluid passageways can immobilize particulates or fibers that were formed when the passageways were formed, so that such metalized passageways can be less susceptible to shedding of particulates that could otherwise obstruct small ink passageways in the printhead die 251. Such metallization can be provided by electroplating the holes through the electrically insulating support 268, for example.

Figure 9:
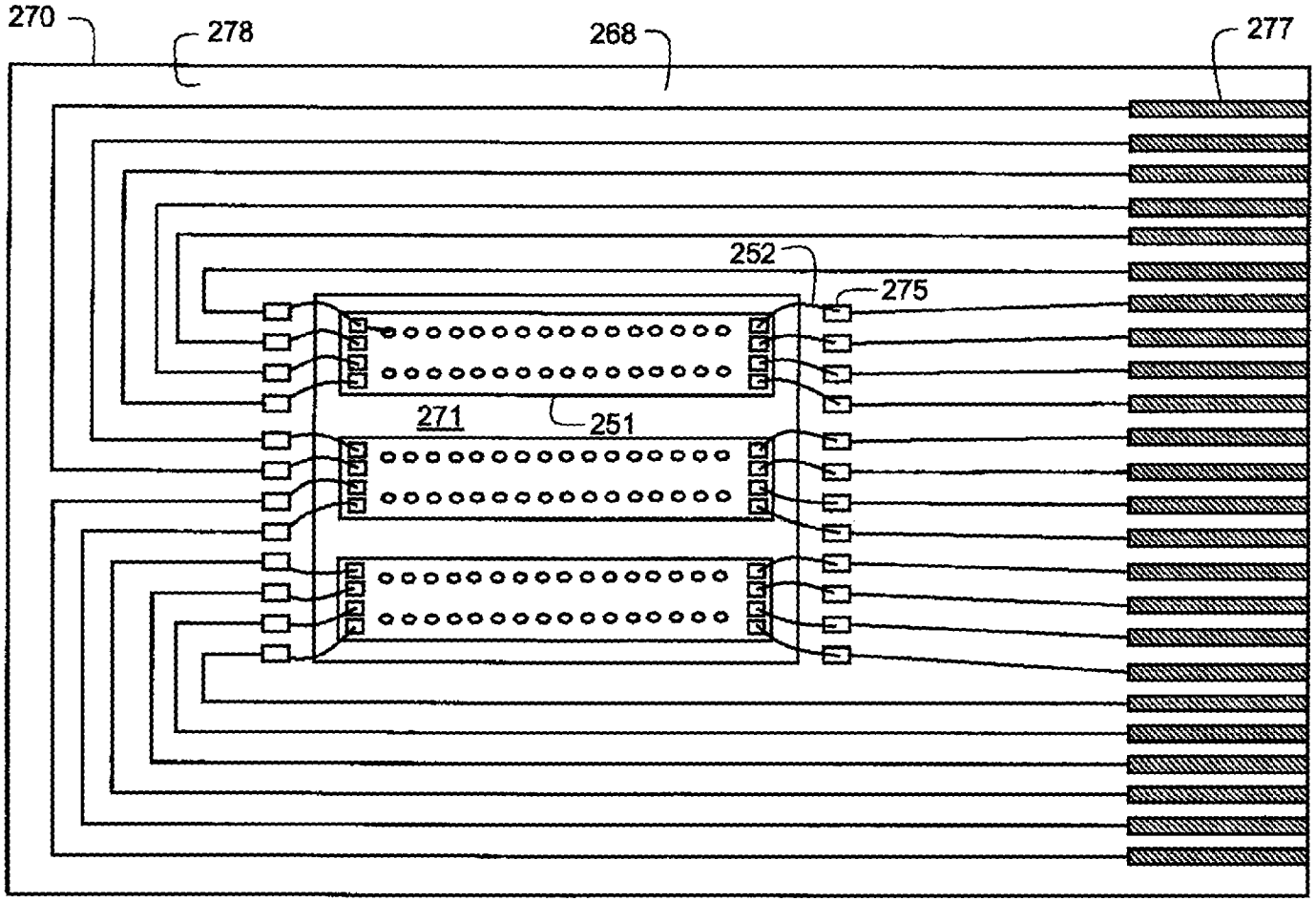
FIG. 9 is a schematic top view of printhead ejector die bonded to a metalized substrate.

FIG. 9 shows a schematic representation of three printhead die 251 having been die bonded to the metalized substrate 270 (corresponding to a single sided metalized substrate of FIG. 8A or 8B but rotated 90 degrees) in the die mount region 271. In addition wire bonds 252 are shown providing electrical interconnection between printhead die 251 and bond pads 275 on metalized substrate 270.

Figure 10:
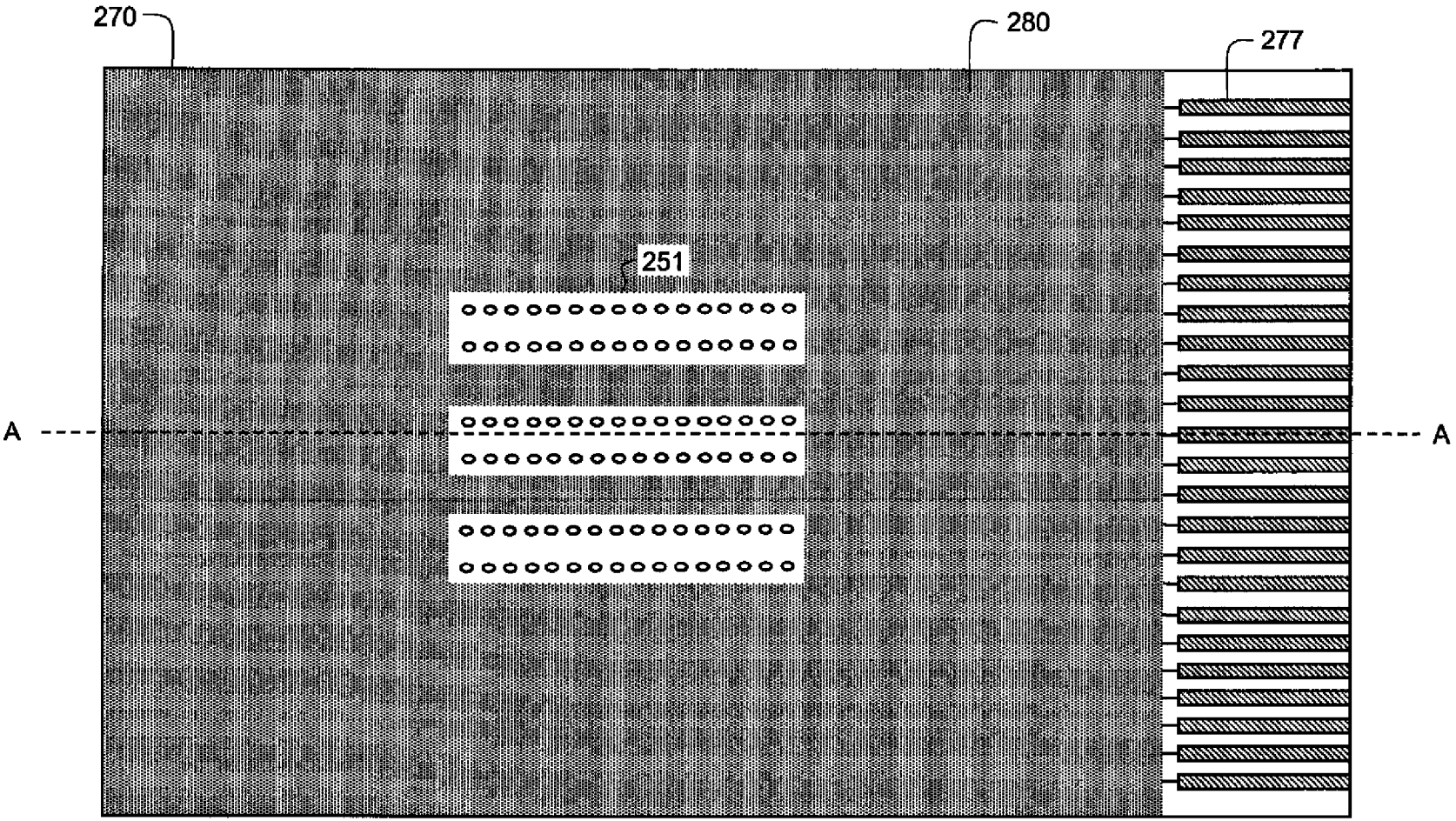
FIG. 10 is a top view of the metalized substrate of FIG. 9 after overmolding, according to an embodiment of the invention.

FIG. 10 shows the same view as FIG. 9, but after the overmolding step has been done. In overmolding, the metalized substrate 270 plus bonded printhead die 251 is inserted into a molding tool and a plastic resin or polymer is allowed to flow to some regions, but not to others. In particular, in the example of FIG. 10, the overmolded polymer material 280 has flowed to cover the wire bonds 252 and the ends of the printhead die 251 that the wire bonds 252 are attached to. The polymer material 280 also covers the bond pads 275 and much of the leads 276, but the polymer material 280 has not been allowed to flow onto connection pads 277. In a subsequent step, connection pads 277 will be electrically connected to connector board 258 (shown in FIG. 2). Polymer material 280 has also flowed between adjacent printhead die 251.

Figure 11:
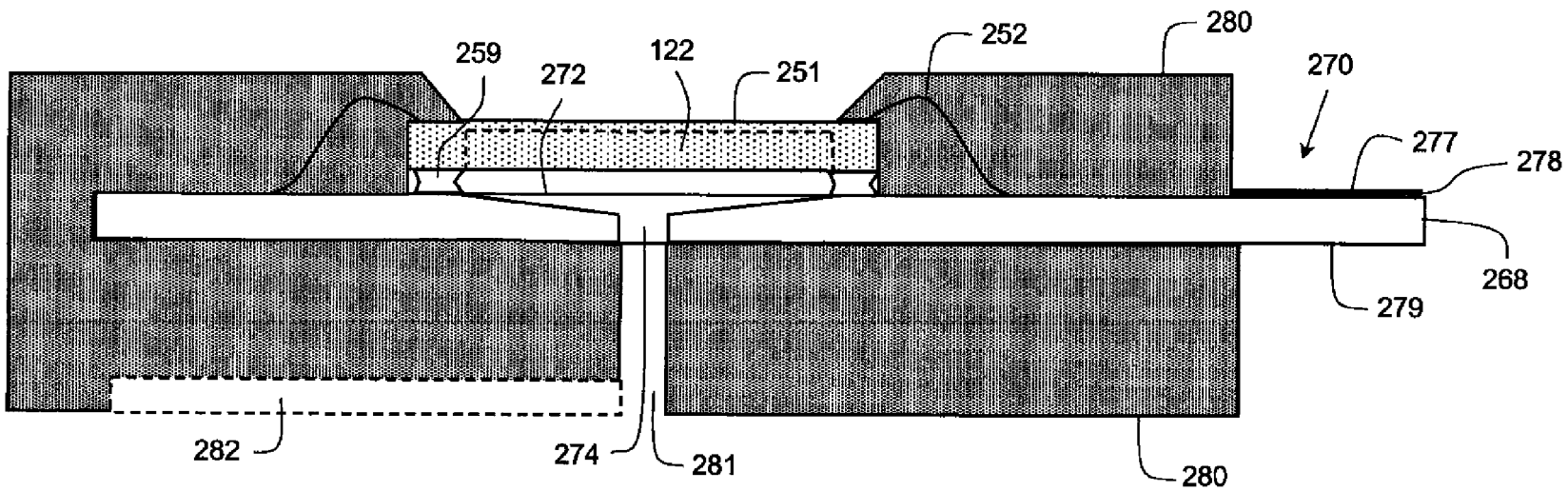
FIG. 11 is a cross-sectional view along line A-A of FIG. 10.

FIG. 11 shows a cross-sectional view along A-A of FIG. 10. In FIG. 11 it can be seen that the overmolded polymer material 280 has been allowed to flow to cover a portion of the second surface 279, as well as a portion of the first surface 278 of electrically insulating support 268. The overmolding tool has formed a fluid passageway 281 in polymer material 280 positioned perpendicular to the electrically insulating support 268, such that fluid passageway 281 is in fluid communication with the fluid passageway 274 in electrically insulating support 268. Fluid passageway 274 in the example of FIG. 11 has the shape of a hole on the second surface 279, but elongates into the shape of a slot on the first surface 278 of electrically insulating support 268. Fluid passageway 274 is also in fluid communication with ink delivery pathway 122 of printhead die 251. Die bond adhesive 259 affixes printhead die 251 to metalized substrate 270, but also fluidically seals the connection between fluid passageway 274 and ink delivery pathway 122. Optionally, the overmolding tool also forms a groove 282 that is parallel to electrically insulating support 268, where groove 282 can serve as a lateral fluid passageway as discussed below.

The controlled flow of overmolded polymer material 280, as seen in FIGS. 10 and 11 provides a low profile face for the printhead that is able to protect the wirebonds and the fragile nozzle face of printhead die 251, but also allows maintenance operations during printing, such as wiping. The low profile face allows positioning of the nozzle face close to the print medium for accurate drop placement without risking collisions with the print medium that can damage the print or the nozzle face.

Figure 12B:
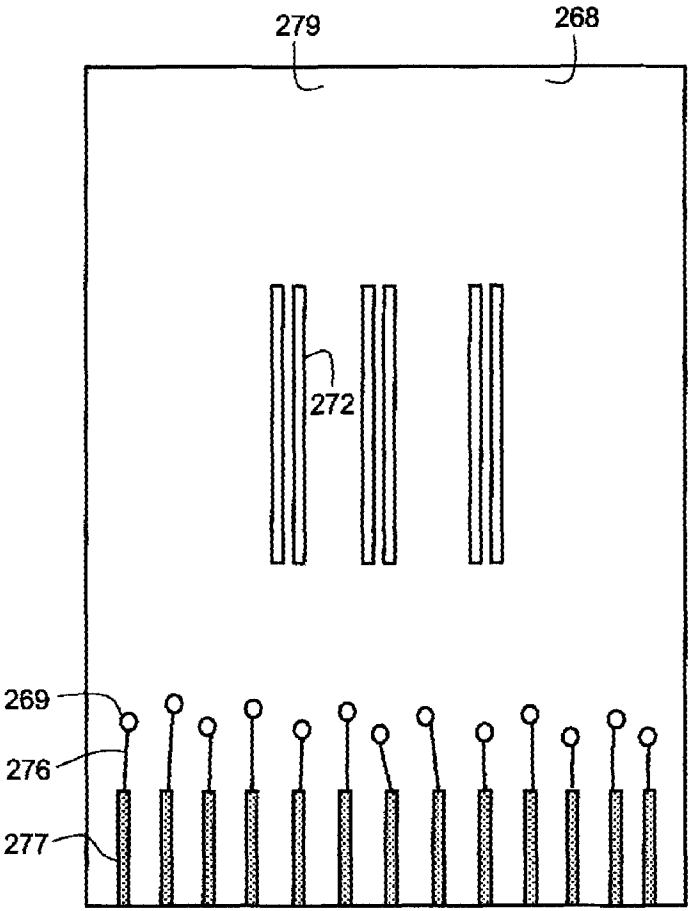
FIGS. 12A and 12B are schematic top and bottom views respectively of a double sided metalized substrate.
Figure 12A:
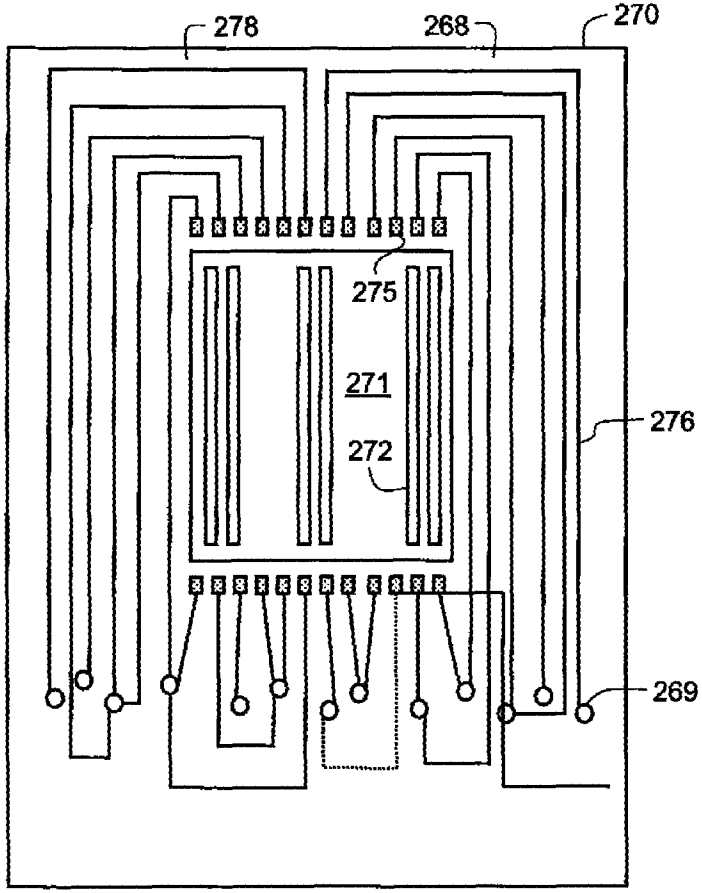

In the metalized substrates 270 of FIGS. 8A and 8B, the electrical traces were only on first surface 278 of electrically insulating support 268. In other embodiments, double sided metalized substrates 270 can be used, as shown in FIGS. 12A and 12B. FIG. 12A is a top view of double sided metalized substrate 270, and FIG. 12B is a bottom view of the same double sided metalized substrate. Metalized substrate 270 has an electrically insulating support 268 such as FR4, BT, or ceramic on which electrical traces have been patterned on first surface 278 and also on second surface 279. For printed circuit substrates such as FR4 and BT, the electrical traces can include layers of nickel, copper and gold, for example. For ceramic substrates, the electrical traces can be screen printed and fired, as is well known in the art. Metalized substrate 270 includes die mount region 271 on first surface 278 of electrically insulating support 268 for mounting printhead die 251. Fluid passageways (optionally metalized as described above with reference to FIGS. 8A and 8B) are formed through the electrically insulating support 268 (extending from a second surface 279 to the first surface 278) for connecting to ink delivery pathways (e.g. 122 and 132) of printhead die 251. In the example shown in FIGS. 12A and 12B these fluid passageways are ink slots 272. The electrical traces include bond pads 275 for wire bonding to the printhead die 251 on the first surface 278, connection pads 277 on the second surface 279, leads 276 to connect the bond pads 275 to corresponding connection pads 277, and metalized vias 269 to connect portions of leads 276 on the first surface 278 with portions of leads 276 on the second surface 279. In the example of FIGS. 12A and 12B, the double sided metallization enables connection pads 277 to be on the opposite side of the electrically insulating support 268 from the bond pads 275 (and also the printhead die 251, not shown in FIGS. 12A and 12B). In this example, there are also fewer connection pads 277 than in the examples of FIGS. 8A and 8B, because some leads have been electrically tied together. For example, the plurality of printhead die 251 can have multiple common leads, such as ground or logic voltage.

Figure 13:
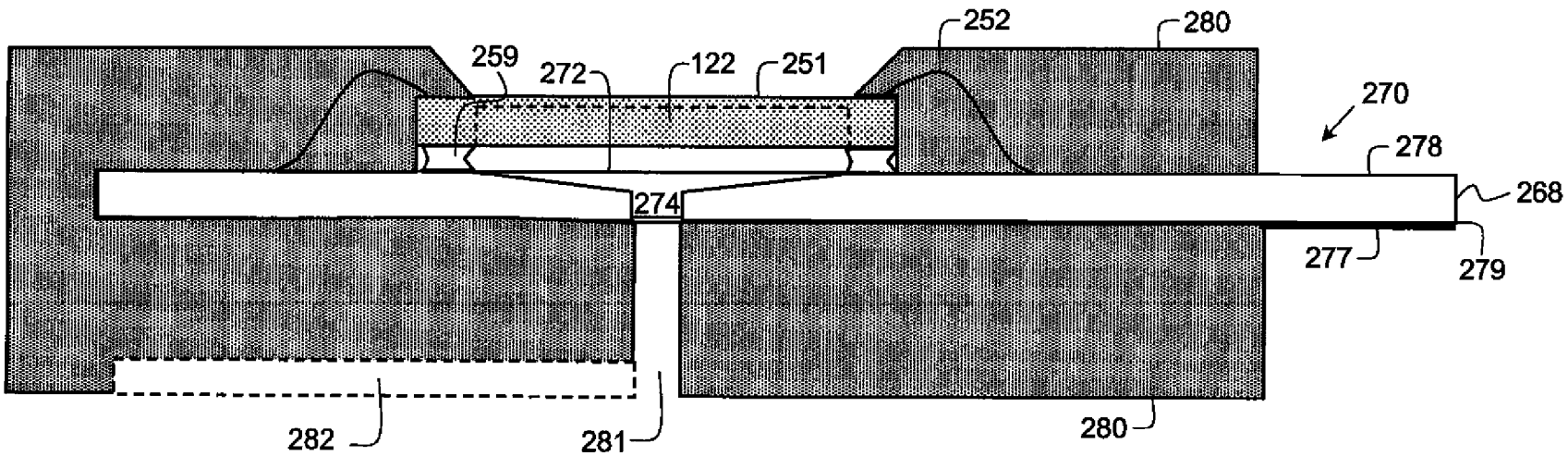
FIG. 13 is a cross-sectional view of a double sided metalized substrate after overmolding, according to an embodiment of the invention.

Overmolding of the double sided metalized substrate 270 of FIGS. 12A and 12B is performed in similar fashion as described above with reference to FIG. 11. FIG. 13 shows an example of an overmolded double sided metalized substrate 270. A difference between FIG. 13 and FIG. 11 is that connection pads 277 are on the second surface 279 in FIG. 13. A portion of the electrical traces located on the second surface 279 (i.e. connection pads 277) remains free of the polymer material.

Figure 14:
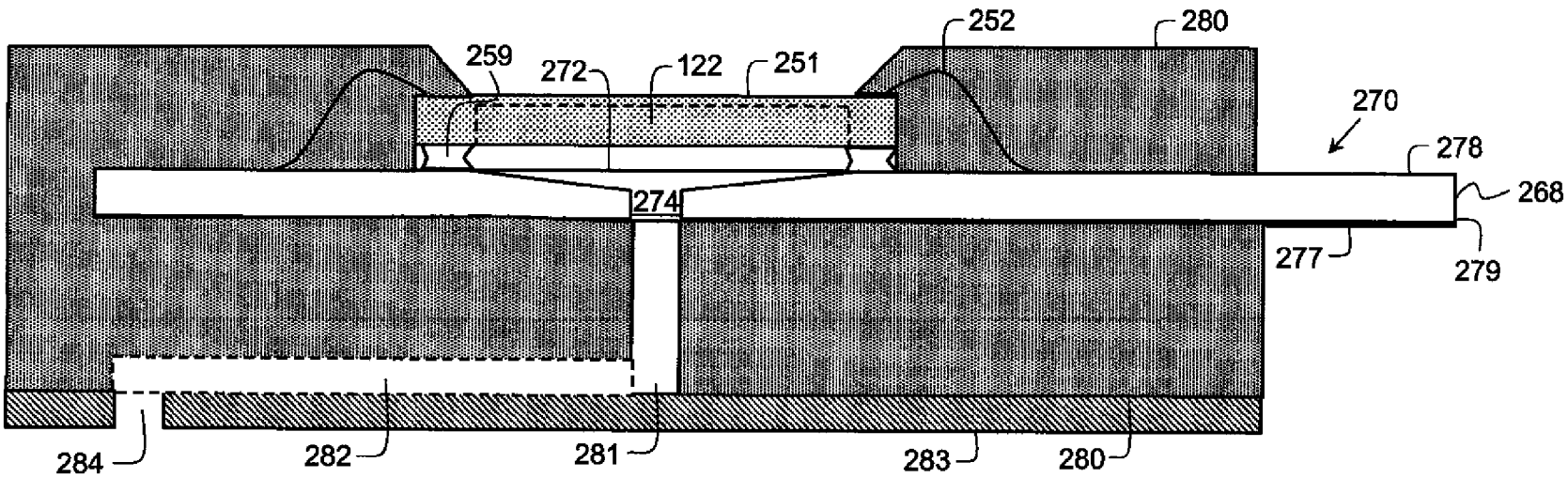
FIG. 14 is the overmolded substrate of FIG. 13 after a material layer has been added to seal the fluid passageways in the overmolded polymer material.

Groove 282 in FIGS. 11 and 13 needs to be sealed in order for it to be an isolated fluid passageway suitable for transporting ink along polymer material 280. In FIG. 14, a material layer 283 is shown affixed to polymer material 280 to cap and seal groove 282. Material layer 283 can be adhesively bonded to polymer material 280, for example. A hole 284 in material layer 283 is provided in fluid communication with groove 282 to serve as an entry port for the fluid passageway formed by the groove 282 and the material layer 283.

Figure 15A:
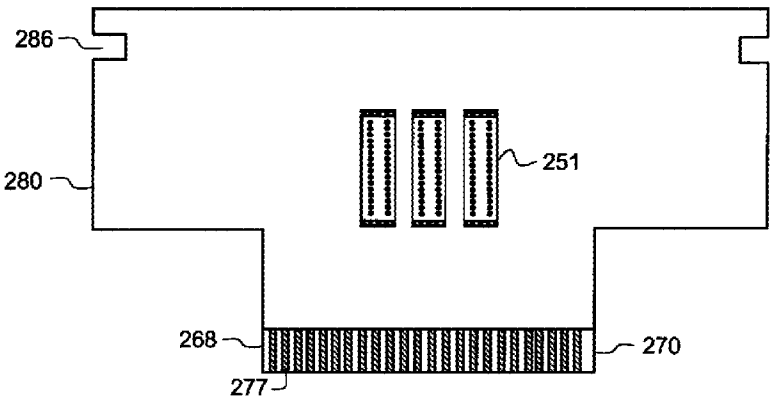
FIGS. 15A and 15B are top and bottom views respectively of an overmolded substrate, according to an embodiment of the invention.
Figure 15B:
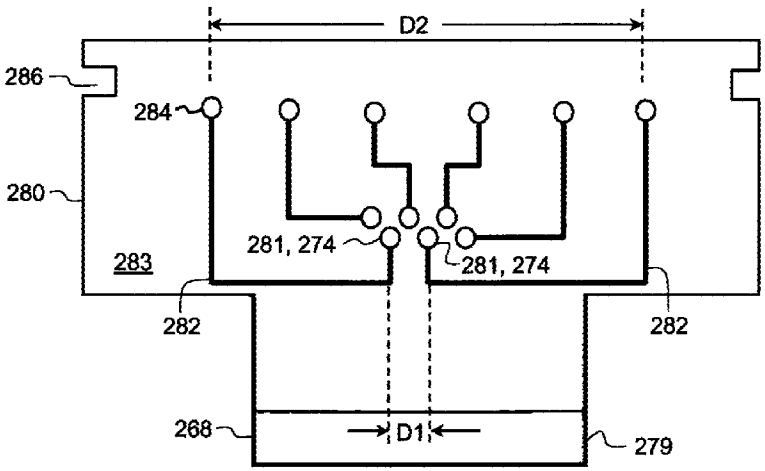

FIGS. 15A and 15B show a top view and a bottom view respectively of another embodiment of an overmolded metalized substrate for a liquid ejector. Connection pads 277 are shown in FIG. 15A as being located on first surface 278 of electrically insulating support 268, but in other examples, the connection pads can be on the second surface 279, shown in FIG. 12B. FIG. 15B illustrates the usefulness of the invention for fanning out the fluid connections from the tight spacing near the printhead die 251 to the wider spacing required for connecting to the ink inlet ports 255 (shown in FIG. 3). In FIG. 15B the fluid passageways 281 in polymer material 280 are in fluid communication with corresponding fluid passages 274 through the electrically insulating support 268. Grooves 282 extend parallel to the electrically insulating support 268 and are fluidically connected to holes 284 in material layer 283. The distance D2 between fluid passageways formed by two separate grooves 282 near holes 284 is greater than the distance D1 between the corresponding fluid passageways 274 through the electrically insulating support 268.

In addition, FIGS. 15A and 15B show locating features 286 that are formed in the overmolded polymer material 280. Locating features 286 (also referred to as alignment features) can be used to align the overmolded metalized substrate assembly to the carriage. Optionally, additional locating features can be formed in the electrically insulating support 268. The printhead die 251 can be located relative to the locating features in the electrically insulating support 268, and the overmolding features (including the locating features 286) can be molded in relationship to the locating features in the electrically insulating support 268.

Although the figures have shown the various embodiments as individual overmolded metalized substrates, it is also possible to gang together a group of metalized substrates together so that the printhead die assembly, wire bonding, and overmolding steps can be carried out simultaneously on the group of parts. The assembled parts can then also be electrically tested as a group.

In summary, embodiments of the invention provide a mounting substrate that can include electrical leads, protection around the interconnections to the inkjet ejector die, and optionally fluid channels to the die, as well as alignment features, provided in a simple integrated fashion. In addition, a low profile face has been provided for the printhead that is able to protect the wirebonds and the fragile nozzle face of printhead die 251, but also allows maintenance operations such as wiping during printing.

The invention has been described in detail with particular reference to certain preferred embodiments thereof, but it will be understood that variations and modifications can be effected within the scope of the invention.

PARTS LIST

10 Inkjet printer system
12 Image data source

14 Controller
15 Image processing unit
16 Electrical pulse source
18 First fluid source
19 Second fluid source
20 Recording medium
100 Inkjet printhead
110 Inkjet printhead die
111 Substrate
120 First nozzle array
121 Nozzle(s)
122 Ink delivery pathway (for first nozzle array)
130 Second nozzle array
131 Nozzle(s)
132 Ink delivery pathway (for second nozzle array)
181 Droplet(s) (ejected from first nozzle array)
182 Droplet(s) (ejected from second nozzle array)
200 Carriage
210 Manifold
211 Slot connection end
212 Port connection end
213 Fan-out path
240 Insert molded mounting substrate
241 Die mounting portion
242 Slots
243 Die mount surface
245 Extension
246 Alignment feature
247 Alignment feature
250 Printhead chassis
251 Printhead die (or ejector die)
252 Wire bonds
253 Nozzle array
254 Nozzle array direction
255 Ink inlet ports
256 Encapsulant
257 Flex circuit
258 Connector board
259 Die bond adhesive
262 Multi-chamber ink supply
264 Single-chamber ink supply
268 Electrically insulating support
269 Metalized vias
270 Metalized substrate
271 Die mounting region
272 Ink slots
273 Ink holes
274 Fluid passageway
275 Bond pads
276 Leads
277 Connection pads
278 First surface
279 Second surface
280 Polymer material
281 Fluid passageway
282 Groove
283 Material layer
284 Hole
286 Locating feature
300 Printer chassis
302 Paper load entry direction
303 Print region
304 Media advance direction
305 Carriage scan direction
306 Right side of printer chassis
307 Left side of printer chassis
308 Front of printer chassis
309 Rear of printer chassis
310 Hole (for paper advance motor drive gear)
311 Feed roller gear
312 Feed roller
313 Forward rotation direction (of feed roller)
320 Pick-up roller
322 Turn roller
323 Idler roller
324 Discharge roller
325 Star wheel(s)
330 Maintenance station
370 Stack of media
371 Top piece of medium
380 Carriage motor
382 Carriage guide rail
383 Encoder fence
384 Belt
390 Printer electronics board
392 Cable connectors

The invention claimed is:

1. A liquid ejector comprising:

an electrically insulating support having a first surface and a second surface;

an electrical trace beginning on the first surface of the support and ending on the second surface of the support;

an ejector die positioned on the first surface of the support and electrically connected to the portion of the electrical trace located on the first surface of the support; and a polymer material molded over a portion of the ejector die and extending over at least a portion of the first surface of the support and extending over at least a portion of the second surface of the support, wherein a portion of the electrical trace remains free of the polymer material.

2. The liquid ejector of claim 1, wherein the electrically insulating support includes a fluid passageway extending from the second surface of the support to the first surface of the support, the fluid passageway being in fluid communication with the ejector die.

3. The liquid ejector of claim 2, wherein the fluid passageway extending from the second surface of the support to the first surface of the support is metalized.

4. The liquid ejector of claim 2, wherein the polymer material includes a fluid passageway in fluid communication with the fluid passageway of the electrically insulating support.

5. The liquid ejector of claim 2, wherein the fluid passageway located in the polymer material is positioned perpendicular to the electrically insulating support.

6. The liquid ejector of claim 5, wherein the fluid passageway located in the polymer material includes a portion that is parallel to the electrically insulating support.

7. The liquid ejector of claim 2, wherein the fluid passageway located in the polymer material includes a portion that is parallel to the electrically insulating support.

8. The liquid ejector of claim 7, the parallel portion of the fluid passageway that is located in the polymer material comprises a groove in the polymer material.

9. The liquid ejector of claim 8, further comprising a material layer that is affixed to the polymer material such that the groove is fluidically sealed.

10. The liquid ejector of claim 1, wherein the electrically insulating support includes a first fluid passageway extending from the second surface of the support to the first surface of the support and a second fluid passageway extending from the second surface of the support to the first surface of the support, the polymer material including a first fluid passageway in fluid communication with the first fluid passageway of the electrically insulating support and a second fluid passageway in fluid communication with the second fluid passageway of the electrically insulating support.

11. The liquid ejector of claim 10, the second fluid passageway of the electrically insulating support being spaced apart from the first fluid passageway of the electrically insulating support by a distance D1, the second fluid passageway of the polymer material being spaced apart from the first fluid passageway of the polymer material by a distance D2, wherein D2 is greater than D1.

12. The liquid ejector of claim 1, wherein the fluid passageway located in the polymer material includes a portion that is parallel to the electrically insulating support.

13. The liquid ejector of claim 1, wherein the polymer material includes a locating feature.

14. The liquid ejector of claim 1, the ejector die being a first ejector die, the electrical trace beginning on the first surface of the support and ending on the second surface of the support being a first electrical trace, the liquid ejector further comprising:

a second electrical trace beginning on the first surface of the support and ending on the second surface of the support; and a second ejector die positioned on the first surface of the support and electrically connected to the portion of the second electrical trace located on the first surface of the support, the second ejector die being spaced apart from the first ejector die, a portion of the polymer material being located in the space between first ejector die and the second ejector die.

15. The liquid ejector of claim 1, wherein the portion of the first surface that the ejector die is positioned on is metalized.

16. The liquid ejector of claim 1, wherein the portion of the first surface that the ejector die is positioned on is not metalized.

17. An inkjet printer comprising:

a carriage; and a printhead mounted on the carriage, the printhead comprising:

an electrically insulating support having a first surface and a second surface;

an electrical trace on the first surface of the support;

an ejector die positioned on the first surface of the support and electrically connected to the portion of the electrical trace located on the first surface of the support; and a polymer material molded over a portion of the ejector die and extending over at least a portion of the first surface of the support and extending over at least a portion of the second surface of the support, wherein a portion of the electrical trace remains free of the polymer material.

18. The inkjet printer of claim 17, wherein the electrically insulating support includes a fluid passageway extending from the second surface of the support to the first surface of the support, the fluid passageway being in fluid communication with the ejector die.

19. The inkjet printer of claim 18, wherein the polymer material includes a fluid passageway in fluid communication with the fluid passageway of the electrically insulating support.

20. The inkjet printer of claim 17, wherein the polymer material includes a locating feature to locate the printhead to the carriage.

* * * * *